United States Patent [19]

Shepherd, Charles G.

[11] 4,361,523

[45] Nov. 30, 1982

[54] HUMIDIFIER

[75] Inventor: Shepherd, Charles G., Oakville, Canada

[73] Assignee: B. D. Wait Co. Limited, Oakville, Canada

[21] Appl. No.: 257,441

[22] Filed: Apr. 24, 1981

Related U.S. Application Data

[63] Continuation of Ser. No. 84,938, Oct. 15, 1979, abandoned.

[30] Foreign Application Priority Data

Oct. 10, 1979 [CA] Canada ..... 337350

[51] Int. Cl.[3] ..... B01F 3/04

[52] U.S. Cl. ..... 261/92; 126/113; 261/DIG. 15

[58] Field of Search ..... 261/92, DIG. 15, 80; 126/113

[56] References Cited

U.S. PATENT DOCUMENTS

| | | | |
|---|---|---|---|
| 2,858,825 | 11/1958 | Skerritt | 261/DIG. 15 |
| 3,400,919 | 9/1968 | Schall | 261/DIG. 15 |
| 3,437,318 | 4/1969 | Abbott et al. | 261/DIG. 15 |
| 3,481,588 | 12/1969 | Lobb | 261/DIG. 15 |
| 3,599,942 | 8/1971 | Herr | 261/92 |
| 3,724,824 | 4/1973 | Mitich | 261/92 |
| 3,823,922 | 7/1974 | McElreath | 261/92 |
| 3,823,926 | 7/1974 | Bracich | 261/DIG. 15 |
| 3,975,470 | 8/1976 | Engel | 126/113 X |
| 4,056,582 | 11/1977 | Chow | 261/DIG. 15 |

*Primary Examiner*—Richard L. Chiesa
*Attorney, Agent, or Firm*—Hirons, Rogers & Scott

[57] ABSTRACT

A housing for a humidifer is provided which facilitates assembly of the humidifier with the inlet duct positioned either to the left or to the right of the humidifier housing. This assembly is made possible by providing the housing with similar first and second walls and a pair of end walls which extend between the first and second walls. A back defines a first opening and one of the ends defines a second opening midway between the first and second walls so that air can be humidified by passing the air through the housing between the first and second openings. The other of the ends is adapted to receive drive means for driving a humidifier from inside the chamber and one of the ends provides means adapted to receive a water inlet assembly so that the housing can be assembled with one or the other of the first and second walls uppermost depending upon the desired location of the second opening.

4 Claims, 5 Drawing Figures

HUMIDIFIER

This is a continuation of application Ser. No. 06/084,938 filed Oct. 15, 1979 and now abandoned.

This invention relates to humidifiers of the type used with a forced warm air heating system. The humidifier is normally attached to ducting adjacent the warm air source such as an oil furnace and arranged so that the humidifier receives air from the warm air outlet and returns this air to the inlet of the furnace. There is a positive differential pressure between air leaving and air entering the furnace caused by the blower fan and this is used to cause a flow of some of the air through the humidifier.

Humidifies of various kinds have been used for many years in association with warm air systems such as those associated with oil or gas furnaces. In general they consist of a housing containing a cylindrical pad which is driven to rotate while partially submerged in a reservoir of water. As the air passes over and through the pad it is humidified and the water in the reservoir is replenished using a float valve arrangement. Such humidifiers have proven to be reliable and are in widespread use.

The humidifier is usually arranged so that it is attached to the warm air outlet duct and has a side opening for connection via an intermediate pipe to the inlet duct. It is not uncommon for hot air furnaces to be located in places where the location of the inlet duct can be only to the left of the humidifier housing or to the right. To facilitate installation in both of these arrangements, manufacturers provide both ends of the humidifier with large openings which are adapted to receive either a collar for connection to the intermediate pipe or a plate which both covers the opening and supports the drive motor. These large openings require that the material of the humidifier housing be quite robust. Small screws are often used to fasten the plate and duct collar in position. These screws must be engaged in the ends while working in confined surroundings and often in poor lighting.

The present invention is intended to provide a humidifier of the aforementioned type which can be manufactured from a lighter gauge material and which is readily assembled whether or not the inlet duct is positioned to the left or to the right of the humidifier housing. It is also intended that the installation be simplified, that the parts needed be minimized and that the humidifier be less expensive to manufacture making it more competitive in the marketplace.

Accordingly, in one of its aspects the invention provides a housing for use in a humidifier of the type used with a forced air heating system. The housing defines a chamber having an open front and comprises first and second walls, a pair of ends extending between the first and second walls, and a back defining an inlet opening for receiving air to be humidified. One of the ends defines an air outlet through which humidified air leaves the housing and the other of the ends is adapted to receive drive means for driving a humidifier drum inside the chamber. One of the ends provides means adapted to receive a water inlet assembly so that the housing can be assembled with one or the other of the first and second walls uppermost depending upon the desired location of the air outlet.

In another of its aspects the invention provides a humidifier for use in a forced air heating system. The humidifier has a housing including similar first and second walls arranged in parallel, a pair of parallel ends, and a back extending between the walls and the ends to form an open-fronted chamber. The first and second walls are set back from the forward extremities of the ends. The back defines an inlet opening for receiving air to be humidified and a first of the ends defines an outlet for the humidified air. Bearing means are coupled to the first of the ends and drive means is mounted on the second of the ends in alignment with the outlet. The outlet and the drive means are substantially midway between the first and second walls. A humidifier drum is adapted for engagement both in the drive means and in the bearing means, and a water reservoir is provided for resting on the lower one of the first and second walls whereby the humidifier drum projects into the reservoir to carry water from the reservoir into the stream of air passing between the inlet and the outlet.

These and other aspects of the invention will be better understood with reference to the drawings, in which.

Figure 1:
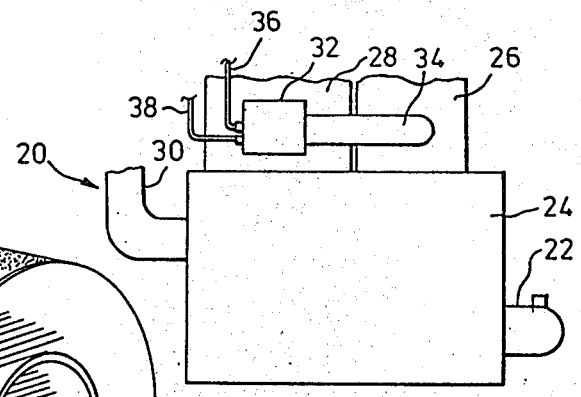
FIG. 1 is an elevational view of a furnace commonly used in a forced air heating system and illustrating the location of a humidifier according to the invention attached to the furnace.

Reference is first made to FIG. 1 which illustrates an exemplary furnace or air heater designated generally by the numeral 20 and having an oil or gas burner 22 attached to a heat exchanger 24. Air enters the heat exchanger via an air return or inlet duct 26 and leaves by way of an outlet duct 28. Exhaust from the burner 22 is carried by a flue 30.

Also as seen in FIG. 1, a humidifier designated generally by the numeral 32 is attached to the outlet duct 28 and coupled to the inlet duct 26 by a pipe 34. The humidifier is serviced by electrical connection 36 and by a water supply pipe 38.

In FIG. 1 the humidifier 32 is shown with the air pipe 34 to the right of the main body of the humidifier. In subsequent views the humidifier will be described as if the pipe were extending to the left and the changes necessary to convert to the position shown in FIG. 1 will then be described.

Figure 2:
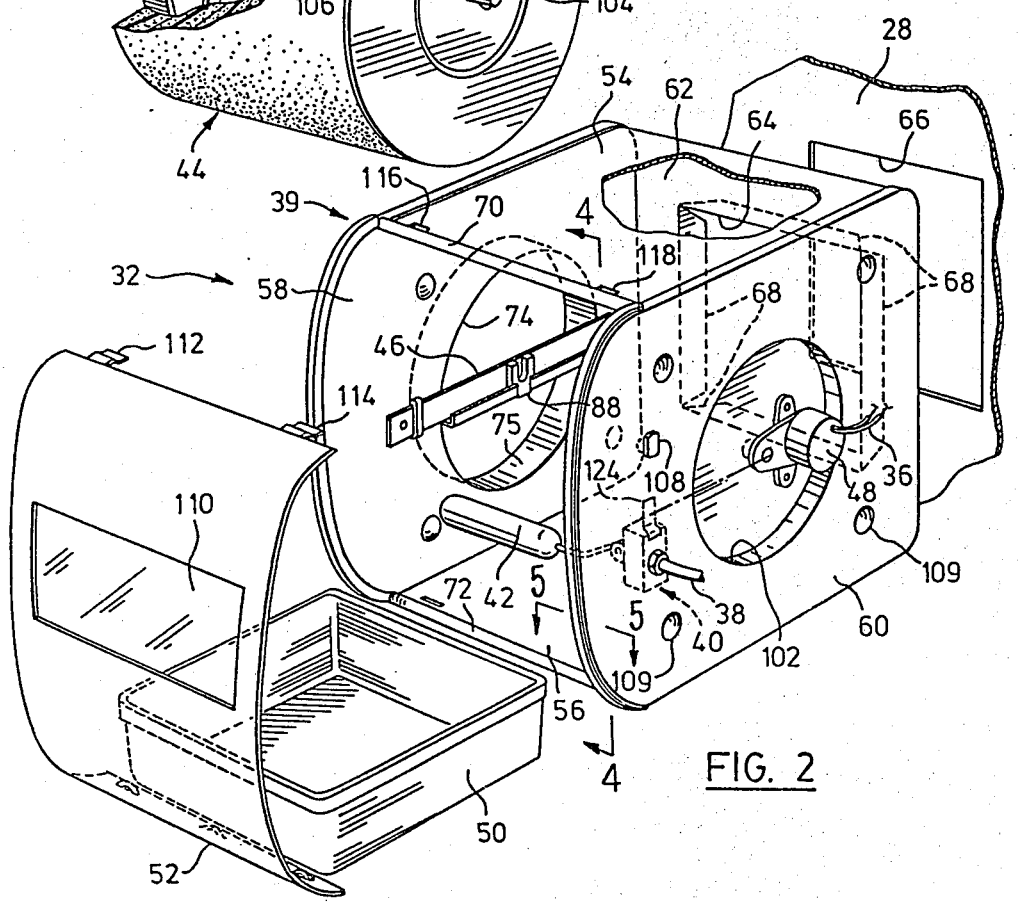
FIG. 2 is an exploded perspective view with parts broken away and illustrating a preferred embodiment of the humidifier positioned for assembly on the heater.

As seen in FIG. 2 the humidifier 32 consists essentially of a housing 39 for attachment to outlet duct 28, a water control assembly 40 having a float 42, a humidifier drum 44 for engagement on a bearing assembly 46 and on a drive unit 48 having an electric motor coupled by the electrical connection 36. The humidifier also includes a reservoir or water tray 50 for engagement in the housing with the humidifier drum 44 partly submerged in water contained in the reservoir. The level of the water in the reservoir is maintained by the water control float valve assembly so that as water is used to humidify the air the water is replenished continuously from the water feed pipe 38. A door 52 is also provided to seal the housing and to prevent air losses caused by differential pressures.

The housing 39 consists of first and second walls 54, 56 arranged in parallel and normally horizontal in use, upright ends 58, 60 and a back 62. These parts combine to provide an open-fronted chamber, the opening being defined by the forward extremities of the walls 54, 56 and ends 58, 60. It is to be noted for reasons which will be explained that the forward extremities of the ends 58, 60 project beyond the extremities of the walls 54, 56.

The back 62 defines an inlet opening 64 of similar size and shape to an opening 66 in the outlet duct 28. The opening 64 is bounded by deformable flaps 68 which can be folded inside opening 66 and brought into engagement with the inner surface of the duct 28 to retain the humidifier in position on this duct.

The back 62 is integral with walls 54, 56 and blends smoothly into these walls which terminate at respective front rolls 70, 72.

The ends 58, 60 are formed separately and subsequently attached to the back and walls. The end 58 defines an outlet opening 74 located midway between the walls 54, 56 and a drawn collar 75 projects outwardly forming an integral part of the end 58.

Figure 3:
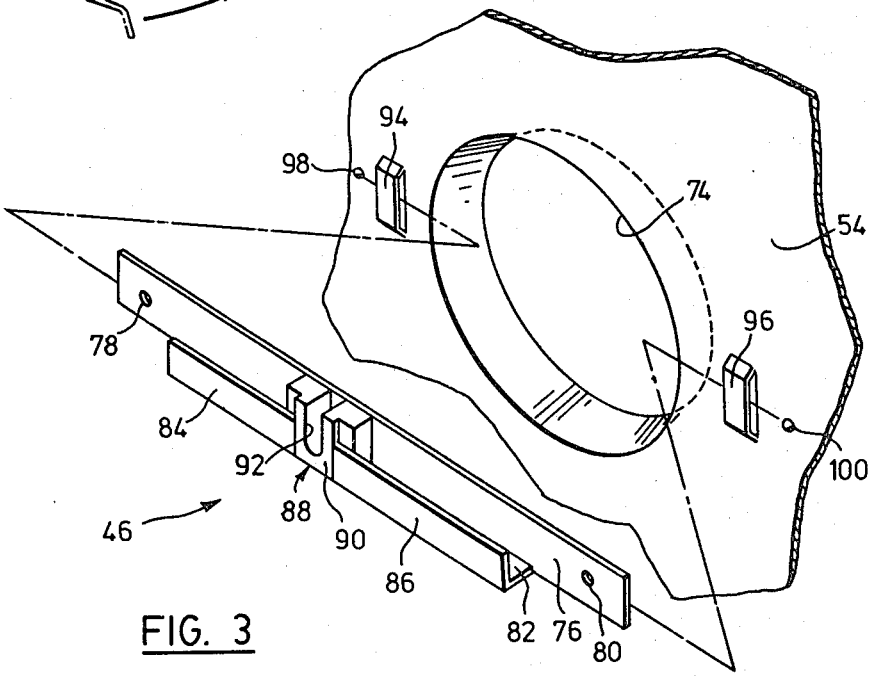
FIG. 3 is a perspective view of a portion of the humidifier illustrating a bearing assembly.

The bearing assembly 46 is coupled to the end 58 as best seen in FIG. 3 which is drawn to a larger scale than that used for FIG. 2.

As seen in FIG. 3 the bearing assembly 46 is made from sheet metal and consists of a main portion 76 having small location openings 78, 80 adjacent its ends, a projection 82 extending from a lower extremity of the main portion 76 and terminating in a pair of upright flanges 84, 86 which serve to both rigidify the structure and to locate a bearing block 88. This block has a frontal boss 90 attached to fit between the flanges 84, 86 and the block defines a downward recess 92 shaped to receive an axial projection on the humidifier drum as will be described.

The bearing assembly 46 is attached to the end 54 across opening 74 by engagement in a pair of straps 94, 96. These straps are lanced from the material of the end 54 and remain integral with this end. Also, a pair of dimples 98, 100 are formed in the end 54 and positioned outwardly from the respective straps 94, 96 and aligned generally centrally with these straps. The distance between the dimples 98, 100 is similar to the distance between the locating openings 78, 80 in the bearing assembly 46.

To assemble the bearing assembly one end is engaged in one of the straps 94, 96 and slid axially until the other end of the main portion 76 of the bearing assembly has passed beyond the other strap. The bearing assembly is then moved in the opposite direction to bring this end of the main portion into and through the other strap and the movement is continued until such time as the dimples 98, 100 engage in the locating openings 78, 80 of the main portion 76. The bearing assembly is then located on the end 54 such that when the drum is engaged on the bearing assembly the axis of the drum will coincide with the centre of the opening 74, the main portion acting as an end strap.

The end 60 is deformed to define an external dish or recess 102 and the drive unit 48 is attached to this end within the recess 102. The drive unit is conventional and includes an electric motor and gear box and an output shaft which projects through the end 60 and is shaped to receive an end coupling 104 on the drum 44. This coupling is formed on one end of a central shaft 106 which also projects beyond the opposite end of the drum for engagement in the bearing block 88. When assembled the axis of the shaft 106 lies parallel to the first and second walls 54, 56 and is spaced midway between these walls. To achieve this the output shaft of the drive unit 48 is aligned with the bearing block 88 at a point midway between the first and second walls 54, 56.

The end 60 is perforated at an opening 108 and at a second similar opening (not shown) and through which the water control assembly projects. These openings are located equidistantly from the respective first and second walls 54, 56 and positioned in similar relationship to the back 62. As will be described either one of the openings can be used to assemble the water control assembly 40 depending upon whether the wall 54 or the wall 56 is uppermost.

When not in use, the opening such as opening 108 can be closed by inserting a suitably formed cap.

It will be noted that the end 58 is in effect rigidified by the provision of the collar 75 and that the end 60 is also rigidified by the provision of the recess 102. The arrangement is such that these ends can be made from relatively light gauge material and retain the advantages of the structure as will be explained.

The walls 58, 60 are also provided with internal projecting pairs of dimples such as dimples 109 shown at the lower part of end 60. These pairs of dimples are at a height to locate reservoir 50 when it rests on one of the first and second walls 54, 56. The dimples locate the reservoir centrally but provide sufficient looseness and space so that the reservoir can be moved for cleaing quite readily. The space provided by the dimples helps to prevent calcium deposit freezing the tray to the end walls.

Both the humidifier drum 44 and the water control assembly are conventional. When the reservoir is located in the housing and the humidifier drum 44 dropped in place the humidifier drum will revolve with part submerged in water contained in the reservoir and maintained at a predetermined height by the water control assembly 40 using the float 42.

Because the humidifier drum 44 engages within the reservoir 50, the reservoir cannot be removed with the drum in place. Consequently it must be possible to first remove the humidifier drum 44 and then subsequently withdraw the reservoir 50. To facilitate this, space must be provided for the drum to pass over the outward wall of the reservoir. This is provided by setting the first wall 54 back from the ends 58, 60. The humidifier drum can then be withdrawn upwardly and outwardly, the limit of the upward movement being defined by the roll 76.

As mentioned earlier, the humidifier can be assembled on the furnace either on the position shown in FIG. 1 or in a position in which the pipe 34 projects to the left of the humidifier. To install the humidifier, the preassembled housing and drive unit 48 is positioned on the outlet duct 28 with one of the walls 54, 56 uppermost. If the pipe 34 (FIG. 1) is to project to the left, then the humidifier housing will be attached in the position shown in FIG. 2. However, if the pipe 34 is to project to the right as shown in FIG. 1, then the housing would be attached with the wall 56 uppermost. Next, the lower of the two openings 108 is used to receive the water control assembly 40 and the other of the openings is closed off using a suitable cap as previously described. Next, the bearing assembly 46 is engaged inside the end 58, the tray positioned, and the humidifier drum 44 entered into the housing and positioned on the bearing block 88 and the outlet shaft of the drive unit 48. Water and electricity can then be connected and the humidifier is ready for use. It will be noted that apart from the actual attachment to the furnace duct 28 the only tools needed are those necessary to attach the water pipe 38 and electrical connection 36. A standard round duct or pipe can be attached to the humidifier by pushing it over the collar 75 and the assembly is completed by engaging the door 52 as will now be described.

Figure 4:
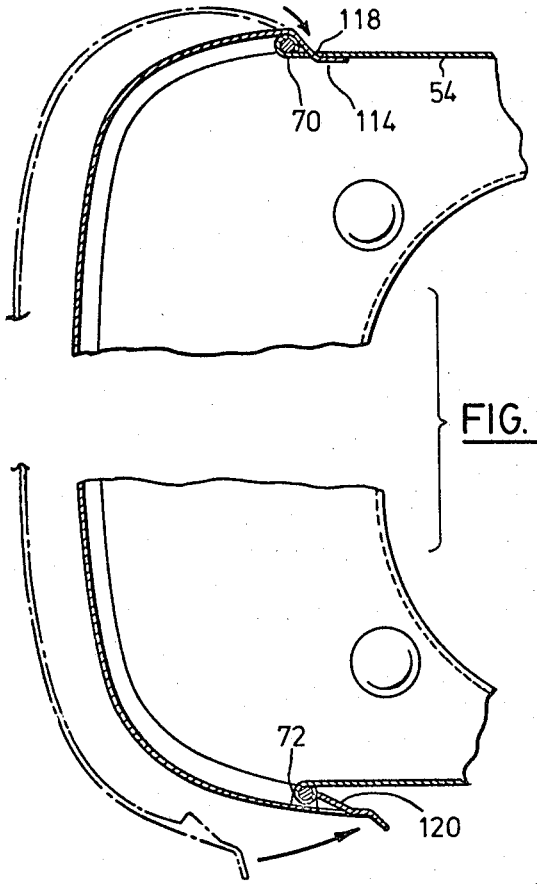
FIG. 4 is a sectional side view on line 4—4 of FIG. 2 and illustrating a door in a closed position, the door also being shown in ghost outline in an open position.

The door 52 is preferably stainless steel and although thin it is quite stiff and retains its shape. The door consists essentially of a main panel defining an opening containing a window 110 and having a pair of engagement tongues 112, 114 for locating in a pair of slots 116, 118 suitably located in the panel 54. The tongues 112, 114 are similar in shape and the tongue 114 can be better seen in FIG. 4. It will be seen in FIG. 4 that the tongue 114 is cranked so that its end can lie in face-to-face relationship with the inner surface of wall 54 while the rest of the tongue projects through the opening 118 meeting a forward extremity of the main panel on roll 70. This effectively locks the door in position because it cannot be withdrawn outwardly due to the arrangement of the tongues in the slots.

The lower extremity of the door is cranked outwardly to provide a finger grip and three lanced projections 120 project behind roll 72 to lock the door in position. The door can be opened quite readily by prying the bottom of the door downwardly to disengage the projections 120 from the roll 72 and then the door can be lifted upwardly using the tongues 112, 114 essentially as hinges. If it is necessary to remove the door, the door can be moved into a generally horizontal position and then lifted upwardly to disengage the tongues from the slots 116, 118.

Figure 5:
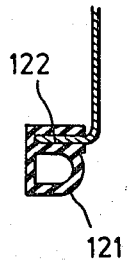
FIG. 5 is a sectional view on line 5—5 of FIG. 2.

The door is biassed to engage quite snugly against the rolls 70, 72, but to improve sealing, forward extremities of the ends 58, 60 are provided with sealing strips of a type best seen in FIG. 5. These strips are hollow and adapted to engage on an inwardly turned flange 122. This flange extends about the end 60 and is used to attach this end to the walls 54, 56 and back 62 as well as to rigidify the structure. A similar flange extends about the wall 54.

Because the sealing strip 121 is hollow and of resilent material, it is quite flexible so that it deforms quite readily when the door 52 is engaged. In fact, the resiliency of the seal tends to maintain the projections 120 at the bottom of the door in tight engagement against the roll 72 to retain the door in position.

Various modifications to this structure can be made within the scope of the invention. For instance, the structure has been shown using a conventional and standard water control assembly 40. A minor modification to this assembly would avoid the use of two openings 108 in the end 60. As shown in ghost outline in FIG. 2, an opening 124 could be provided midway between the walls 54, 56 and if the water control assembly is designed suitably, the assembly could be fitted in this opening irrespective of which one of the walls 54, 56 is uppermost. For instance the water control assembly could be factory assembled and have an indexing pivot allowing it to be rotated between two positions 120° apart.

In general, the invention provides a humidifier having a housing which can be manufactured from relatively thin gauge materials, which is inexpensive to manufacture due to the minimizing of parts required, and which is readily assembled using a minimum of tools and fasteners. Further, if after assembly it is subsequently necessary to reinstall the humidifier in the reverse position, the humidifier can be disassembled and reassembled without any difficulty.

Although the humidifier has been shown attached to the warm air duct, it is possible to reverse the flow by attaching to the cold air return. This is done to meet space limitations in some installations.

What I claim as my invention is:

1. A humidifier for attachment to the ducts of a forced air heating system to humidify air circulating in the system, the humidifier comprising:

a reversible housing having a back defining a first opening for passage of air, horizontal and similar first and second walls extending forwardly from the back, a pair of ends meeting the back and extending between the first and second walls to form with these walls an open front, the ends projecting forwardly beyond the first and second walls and one of the ends defining a second opening midway between the first and second walls to permit passage of air to be humidified, the air passing through the housing between the openings in the back and said one of the ends with the housing assembled with the second opening to the left or right of the opening as dictated by the location of the ducts of the forced air heating system;

a bearing assembly coupled to said one of the pair of ends;

drive means coupled to the other of the pair of ends;

a door extending over the front between the first and second walls and engaging the forward extremities of the pair of ends;

a water tray supported by the lowermost one of the first and second walls, the uppermost extremity of the tray being spaced from the uppermost one of the first and second walls by a predetermined distance;

a water inlet assembly contained inside the housing and coupled to one of the pair of ends for releasing water into the water tray only to a predetermined level and to maintain this level in use; and a cylindrical humidifier drum having a diameter no greater than said predetermined distance, the humidifier drum being coupled to the drive means and supported by the bearing assembly for rotation by the drive means with the drum projecting into the water below said predetermined level.

2. A humidifier as claimed in claim 1 in which the walls terminate at their forward extremities in rolls.

3. A humidifier as claimed in claim 1 in which said other of the ends is recessed and the drive means is supported within the recess.

4. Equipment for heating a building and for maintaining an acceptable humidity in the building, the equipment comprising:

a forced air furnace having a hot air outlet duct and a cold air return duct, each of these ducts having one of two openings; and a humidifier coupled to the ducts between the two openings for receiving air caused to flow through the humidifier by a pressure differential existing between the outlet duct and the return duct, the humidifier comprising: a housing attached to one of the outlet and return ducts and having an opening in registration with the opening in this duct, horizontal and similar first and second walls extending in parallel forwardly from the back, a pair of ends meeting the back and extending in parallel between the first and second walls to form with the walls an open front, the ends projecting forwardly beyond the first and second walls and one of the ends defining a first opening midway between the first and second walls; means connecting said first opening to the opening in the other of the outlet and return ducts; a bearing assembly coupled to said one of the pair of ends; drive means coupled to the other of the pair of ends; a door extending over the front between the first and second walls and engaging the forward extremities of the pair of ends to close the chamber; a water tray supported by the lowermost one of the first and second walls, the uppermost extremity of the tray being spaced from the uppermost one of the first and second walls by a predetermined distance; a water inlet assembly contained in the housing and coupled to one of the pair of ends for releasing water into the water tray only to a predetermined level and to maintain this level in use; and a cylindrical humidifier drum having a diameter no greater than said predetermined distance, the humidifier drum being coupled to the drive means and supported by the bearing assembly for rotation by the drive means with the drum projecting into the water below said predetermined level.

* * * * *